US010751679B2

(12) United States Patent
Bergamini

(10) Patent No.: US 10,751,679 B2
(45) Date of Patent: Aug. 25, 2020

(54) CONTAINER WITH A STIRRER DEVICE FOR FLUID PRODUCTS

(71) Applicant: Corob S.p.A., San Felice sul Panaro (IT)

(72) Inventor: Andrea Bergamini, Nonantola (IT)

(73) Assignee: Corob S.p.A., San Felice sul Panaro (IT)

( * ) Notice: Subject to any disclaimer, the term of this patent is extended or adjusted under 35 U.S.C. 154(b) by 0 days.

(21) Appl. No.: 15/544,240

(22) PCT Filed: Jan. 15, 2016

(86) PCT No.: PCT/IB2016/050200
§ 371 (c)(1),
(2) Date: Jul. 17, 2017

(87) PCT Pub. No.: WO2016/113708
PCT Pub. Date: Jul. 21, 2016

(65) Prior Publication Data

US 2018/0008945 A1 Jan. 11, 2018

(30) Foreign Application Priority Data

Jan. 15, 2015 (IT) ..... UD2015A0003

(51) Int. Cl.
*B01F 13/10* (2006.01)
*B01F 7/16* (2006.01)
(Continued)

(52) U.S. Cl.
CPC ..... *B01F 13/1055* (2013.01); *B01F 7/003* (2013.01); *B01F 7/167* (2013.01);
(Continued)

(58) Field of Classification Search
CPC ..... B01F 7/167; B01F 7/20; B01F 7/00975; B01F 13/1055; B01F 13/1022;
(Continued)

(56) References Cited

U.S. PATENT DOCUMENTS 1,723,620 A * 8/1929 Hottmann ..... B01F 7/00291 241/124
1,922,784 A * 8/1933 Sheriff ..... A23G 9/12 366/291
(Continued)

FOREIGN PATENT DOCUMENTS

DE 417549 C 8/1925
DE 18 15 582 A1 9/1970
(Continued)

OTHER PUBLICATIONS

International Search Report and Written Opinion from corresponding International Application No. PCT/IB2016/050200 dated Apr. 29, 2016; (10 pp).

*Primary Examiner* — Elizabeth Insler
(74) *Attorney, Agent, or Firm* — Calderone Bullock LLC

(57) ABSTRACT

A Container is disclosed with a stirrer device suitable to be installed on machines for dispensing fluid products. The container comprises a tank with a particular configuration defined by two cylinders each having a respective longitudinal axis, wherein the distance between two of the longitudinal axes is less than the diameter of a cylinder, and in which two stirrer units are comprised, coaxial to the cylinders of the tank. The stirrer units have elements that have a radial dimension a little less than the radius of the cylinders and are disposed along the substantial entirety of the longitudinal extension of shafts rotating axially, said shafts not having around them a zone not spatially affected by a stirrer element attached to said corresponding shaft.

17 Claims, 4 Drawing Sheets

(51) Int. Cl.
*B01F 7/00* (2006.01)
*B01F 7/20* (2006.01)
*B01F 15/00* (2006.01)

(52) U.S. Cl.
CPC ..... *B01F 7/20* (2013.01); *B01F 15/00909* (2013.01); *B01F 2215/005* (2013.01)

(58) Field of Classification Search
CPC ..... B01F 2215/005; B01F 7/042; B01F 13/1072; B01F 13/1013; B01F 7/1665; A01J 25/06; A23G 9/12
USPC ..... 366/291, 301
See application file for complete search history.

(56) References Cited

U.S. PATENT DOCUMENTS 2,923,438 A * 2/1960 Logan ..... B01F 13/1058 222/2
4,885,917 A * 12/1989 Spector ..... A23G 9/045 62/343
8,245,871 B2 * 8/2012 Manfredini ..... B01F 13/1022 141/238

FOREIGN PATENT DOCUMENTS

EP 1 744 826 A1 1/2007
FR 319290 A 11/1902
WO WO 92/00665 A1 1/1992

* cited by examiner

CONTAINER WITH A STIRRER DEVICE FOR FLUID PRODUCTS

BACKGROUND OF THE INVENTION

Field of the Invention

The present invention concerns a container comprising a stirrer device for fluid products, such as for example colorant liquids, bases for paints, varnishes, enamels, inks and suchlike, suitable to be installed on machines for dispensing or distributing said fluid products. D1 In particular, the container with the stirrer device for fluid products according to the present invention allows a complete and uniform homogenization of the fluid product contained inside it, facilitated by the particular configuration of the container, increasing the available capacity but at the same time leaving the overall bulk of the dispensing machine substantially unchanged.

Description of Related Art

Machines are known for dispensing or distributing fluid products, such as for example colorants of different shade or color, able to be mixed with each other and/or added to a base substance to make up a varnish or paint of a determinate color.

Known machines normally comprise a plurality of containers containing a determinate colorant, selectively connectable to one or more delivery nozzles and associated with respective pump means that cause the selective delivery of the fluid product contained in them in a suitably chosen quantity, for example using an electronic processor.

Each container comprises inside it a stirrer device, selectively activated, able to prevent the heaviest components present in the fluid from depositing on the bottom of the container, with consequent drying out of the fluid.

In order to prepare the most requested colored varnishes or paints, it is provided to use some colorants more frequently than others, and therefore some containers are finished more quickly than others: this obviously entails more frequent filling or topping up operations which, in some cases, require no less than the stoppage of the dispensing machine.

One known solution to this disadvantage, according to EP 1744826 B1, is to provide containers for fluid products with a greater capacity, having a conformation shaped to define an internal compartment substantially consisting of two cylindrical zones, reciprocally not co-penetrating and connected by an intermediate zone also defining a containing volume of the fluid product. This known technique allows to increase the overall volume for containing the fluid product, obtaining a single container by joining together two cylinders and an additional volume given by the intermediate zone.

It is also known that any container for fluid products needs a stirrer device to prevent the obsolescence of the fluid substance contained in the container. Indeed, if there is no stirring, the fluid product tends to dry out and to deposit its heaviest components on the bottom of the container.

It has been found that, in a container for fluid products configured according to EP 1744826 B1, there are difficulties in stirring all the fluid product contained inside because the stirrer elements provided in correspondence with the cylindrical zones have difficulty in affecting the accumulation zone corresponding to the intermediate zone.

This causes the fluid in the intermediate zone to dry out, and therefore it is not possible to have a homogenous mixing of the fluid inside the whole volume of the internal compartment of the container.

Document DE 417549C (DE'549) describes a machine for refining chocolate that has a tower with a section shape defined by two co-penetrating cylindrical zones in which there are respective mixing elements of the type with a shaft and blades.

This document does not concern a container for fluid products such as colorants or suchlike, suitable to be associated with other analogous containers to a dispensing machine and able to be associated with selective delivery means, but a stable container, large-sized, normally resting on the ground, and intended for long-duration treatments for food products.

Document DE 1815582 A1 describes a machine for mixing solid substances in powder, aggregate or liquid form, inside a receptacle that is also conformed with a section shape defined by two partly co-penetrating cylindrical zones, each associated with a blade-type stirrer element.

This document also shows a machine for stirring and treating substances, but not a container for colorant products or suchlike suitable to be inserted together with other containers in a machine for selectively dispensing colorants.

The same or similar considerations also apply for FR 319290 A (FR'290), which describes a machine for emulsifying pharmaceutical oils, and for WO 92/00665 A1, which describes a container for stirring and cutting compounds to make cheese.

All these prior art documents concern big tanks or towers, suitable for autonomous use, for treating and/or preserving substances, normally food or pharmaceutical products.

One purpose of the present invention is instead to provide a container for fluid products such as colorants or suchlike, small to medium in size and therefore suitable to be inserted, together with a plurality of other containers of the same type, into a dispensing machine for said fluid products, and having a stirrer device configured so as to allow a complete homogenization and mixing of the fluid product contained inside it, until it is selectively delivered for the preparation of the colorant determined by the desired mixture.

Another purpose of the present invention is to improve the configuration of the container for fluid products so as to maintain the advantages given by the greater volume of the internal compartment of the dispensing machine, keeping the bulk of the container unchanged with respect to the dispensing machine on which it is installed, and at the same time eliminating the intermediate zone where stirring is reduced.

Another purpose of the present invention is to improve the disposition and geometry of the stirrer elements inside the container so that there are no zones where the fluid contained inside the container has a substantially zero speed, and at the same time obtains a reduction in the energy needed to move the stirrer elements compared with the state of the art.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claims, while the dependent claims describe other characteristics of the invention or variants to the main inventive idea.

In accordance with the above purposes, a container with a stirrer device according to the present invention, suitable to be installed, together with other containers of the same type, on machines for dispensing fluid products, such as colorants or suchlike, comprises a tank configured so as to be shaped substantially like the figure "8" made by the partial co-penetration of two cylinders, preferably having the same diameters, and in which two respective stirrer units are comprised, disposed coaxial to the respective cylinders and equipped with stirrer elements, for example blades, the radial dimension of which is a little less than a radius of the cylinders.

More specifically, the tank, configured as an "8" shape, has an area of overlapping caused by the co-penetration of the two cylinders, such that the distance between the two longitudinal axes of the cylinders is less than the diameter of the cylinders.

According to one formulation of the present invention, each of the stirrer units comprises at least two stirrer elements, for example blades, attached on rotating shafts and axially disposed at respective different angles so as not to have a zone around each rotating shaft that is not spatially affected by a stirrer element.

According to another characteristic of the present invention, thanks to this conformation of the tank and stirrer elements, the overlapping area is also affected cyclically, reducing to a minimum the intermediate zone, not mixed, and even cancelling it.

Furthermore, this conformation of the container with co-penetrating cylindrical zones allows to further increase the compacting of the containers, compared with the solution of EP'1744826 which is already an improvement, thus allowing to obtain, given the same overall bulk of the machine for dispensing colorants, a greater number of containers, i.e. with the same number of containers a smaller overall bulk of the dispensing machine.

According to another characteristic of the present invention, the stirrer elements have one or more through holes disposed along a vertical axis of the stirrer element translated toward the outside with respect to the central vertical axis of the stirrer element.

Furthermore, the stirrer elements can be made of any suitable material, for example resistant plastic material or steel, or stainless steel or aluminum alloy.

The stirrer elements can have different configurations, for example rectangular or any other quadrangular shape, possibly rounded.

Furthermore, the surface of the stirrer elements can be continuous, or can have through holes disposed on the surface in different ways, or they can be flat or inclined with respect to the axis of rotation.

According to another characteristic of the present invention, the stirrer elements located more adjacent to the bottom of the container, and comprised in each of the two stirrer units, can have an inclined and pointed shape so as to scrape the bottom of the container in order to remove possible sedimentations of paint.

According to another characteristic of the present invention, the stirrer units are installed so as to have between them a radial stagger that can be 90°, or 45° or 30°, or other angles suitable for the number of stirrer elements comprised in each stirrer unit.

According to another formulation of the present invention, each of the stirrer units is connected to a corresponding idle toothed wheel, and both the idle toothed wheels are coupled with a third toothed wheel that imparts rotation motion to the stirrer units by means of a motor, keeping the angle of stagger constant between the stirrer units.

According to another formulation, each stirrer unit is associated with its own independent motor; the two motors are synchronized, for example electronically, in order to maintain the initial stagger and to prevent impacts or interference between the stirrer elements of the stirrer units.

BRIEF DESCRIPTION OF THE SEVERAL VIEWS OF THE DRAWINGS

These and other characteristics of the present invention will become apparent from the following description of some forms of embodiment, given as a non-restrictive example with reference to the attached drawings wherein.

DETAILED DESCRIPTION OF THE INVENTION

Figure 1:
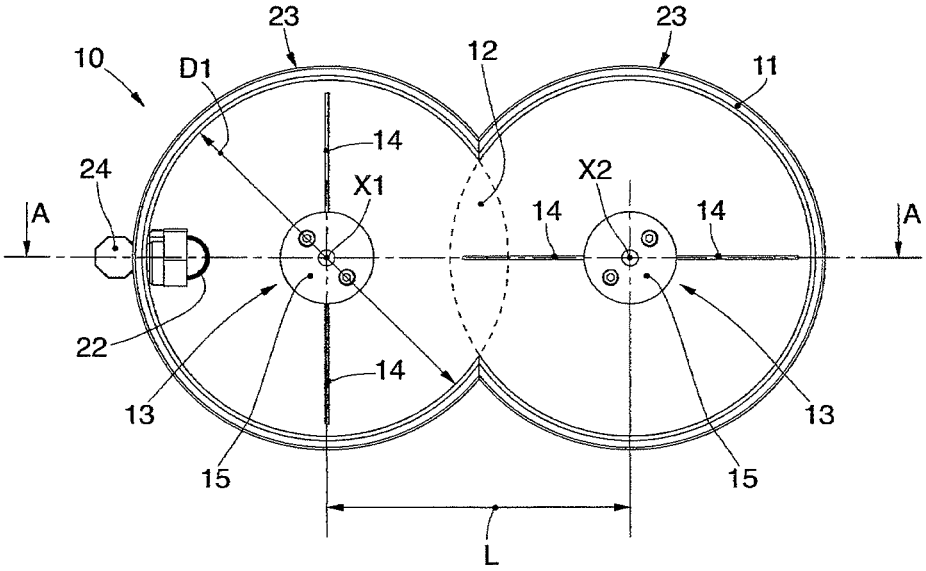
FIG. 1 is a plan view of the container with stirrer device in a particular embodiment.

To facilitate comprehension, the same reference numbers have been used, where possible, to identify identical common elements in the drawings. It is understood that elements and characteristics of one form of embodiment can conveniently be incorporated into other forms of embodiment without further clarifications.

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Figure 2:
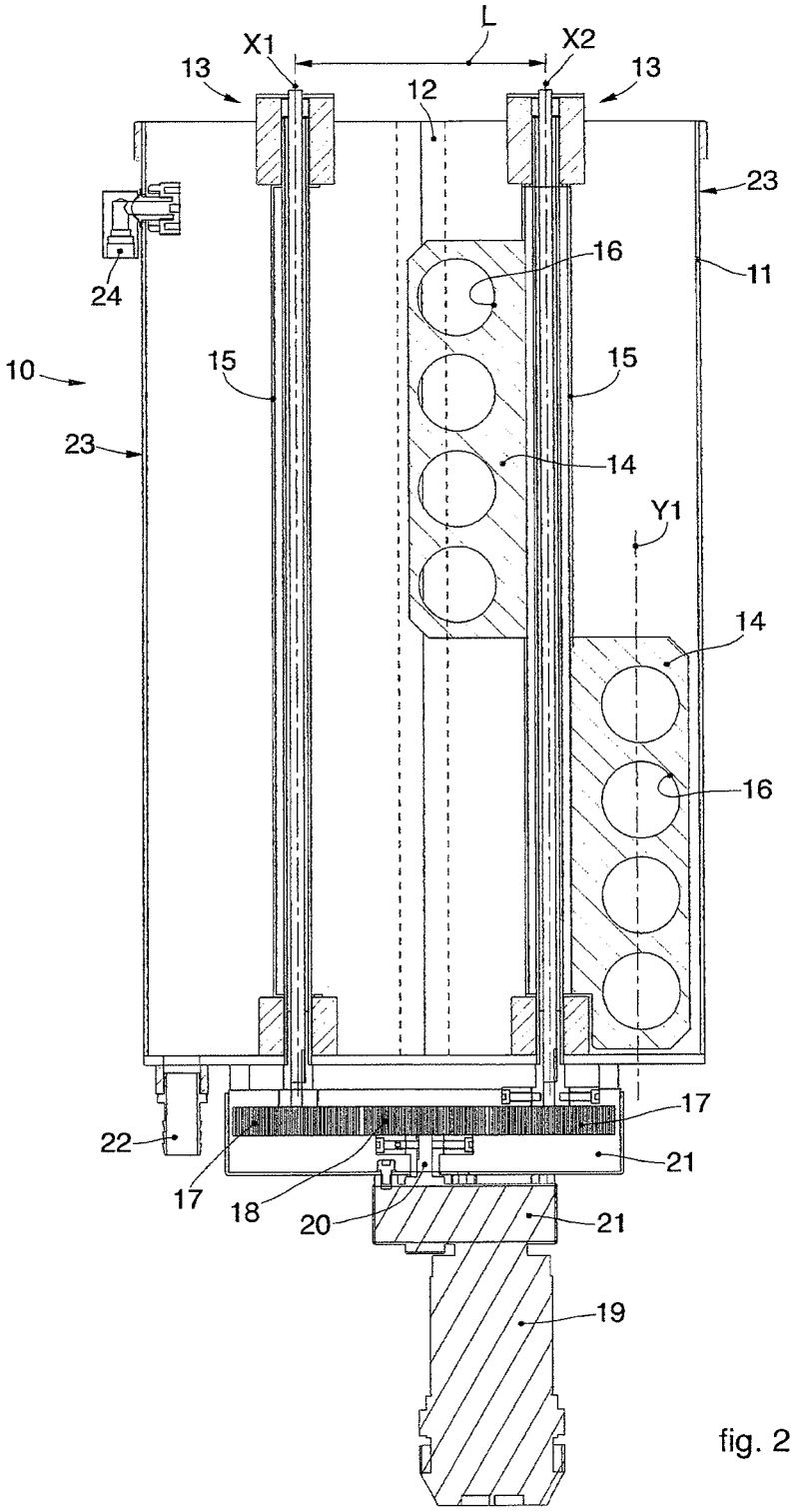
FIG. 2 is a section view of the container with stirrer device in a particular embodiment.
Figure 3:
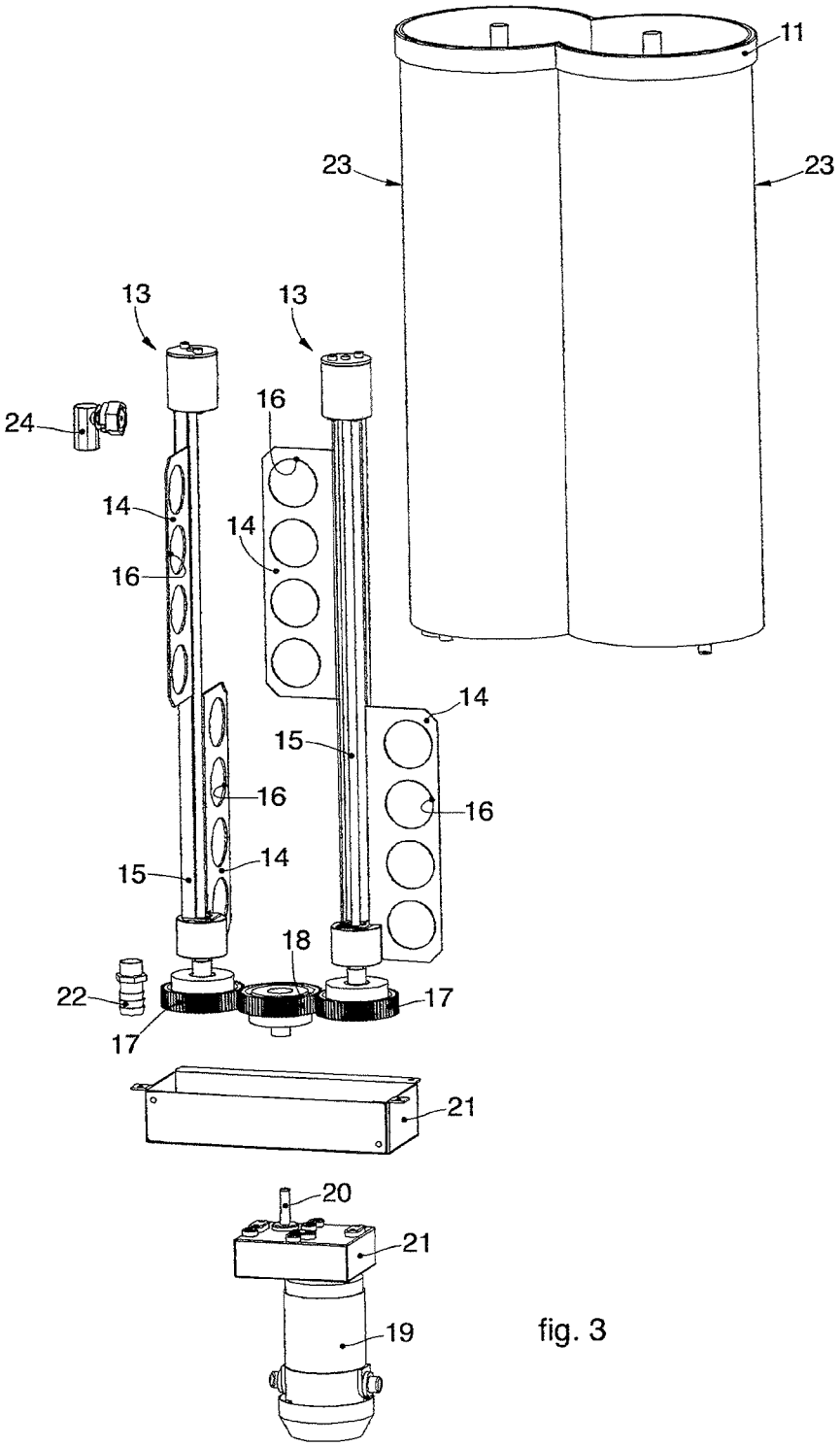
FIG. 3 is a perspective view of the container with stirrer device.

According to the embodiments in FIGS. 1, 2 and 3, the invention concerns a container with a stirrer device for fluid products 10, hereafter referred to simply as container, which comprises a tank 11.

Hereafter in the description, merely by way of non-restrictive example, the fluid product is indicated as a paint, but it can be any other colorant liquid, such as for example a base for paints, an enamel, an ink or suchlike.

In a particular embodiment, the tank 11 can be configured by joining together two cylinders 23, in this case having the same diameter $D_1$ and the same height and which share a zone, called overlapping zone 12 (see FIGS. 1 and 2). The overlapping zone 12 is caused by the co-penetration of the two cylinders 23. This configuration of the tank 11 will be defined hereafter as an "8"-shaped configuration.

According to one embodiment of the present invention, a multitude of tanks 11 of the same type can be installed inside an internal compartment that defines an available surface 25 of a machine for dispensing fluid products, such as for example colorants or suchlike.

Figure 4:
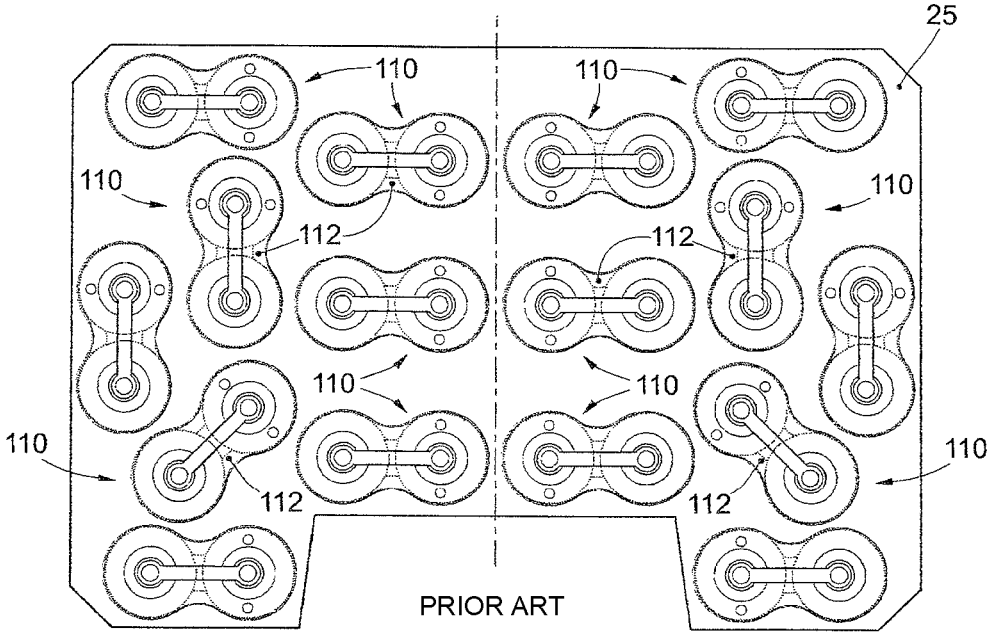
FIG. 4 shows a possible lay-out of a dispensing machine for colorants with a plurality of state-of-the-art containers.
Figure 5:
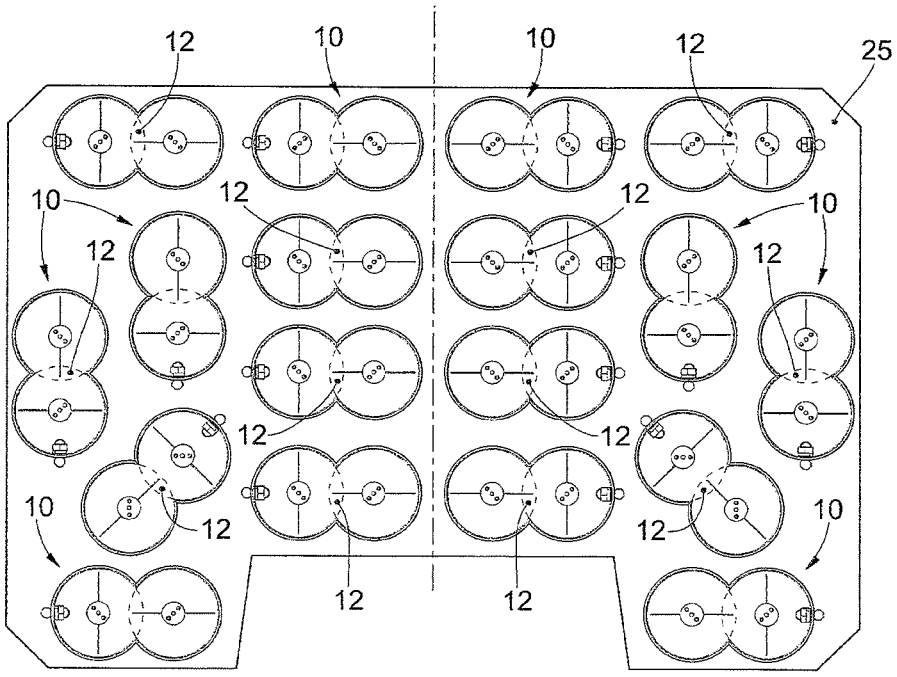
FIG. 5 shows a possible lay-out of a dispensing machine for colorants with a plurality of containers according to the present invention.

Since they have an overlapping zone 12 and do not have any intermediate segment 112, like containers 110 in the state of the art, the tanks 11 according to the present invention can be installed, given the same available surface 25 in a dispensing machine for fluid products, in a greater number than known containers 110 (see the comparison between FIG. 4, which shows the solution of EP'1744826 and FIG. 5 which shows the solution according to the present invention).

This allows to further increase, compared with the solution of EP'1744826 (which is already an improvement), the compacting of the containers, thus allowing to obtain, given the same overall bulk of the dispensing machine, a greater number of fluid product containers, that is, with the same number of containers, a lower overall bulk of the dispensing machine.

The tank 11, in this particular embodiment, comprises two longitudinal axes $X_1$ and $X_2$, each defining the axis of the corresponding cylinder 23, having a distance L between them, less than $D_1$. In substantial correspondence with the longitudinal axes $X_1$ and $X_2$, respective stirrer units 113 can be installed, each provided with an axially rotating shaft 15 coaxial with the respective cylinder 23.

The container 10 therefore comprises two stirrer units 13, one for each cylinder 23, able to carry out the mechanical action of homogenizing and mixing the paint, to prevent it from hardening and drying.

In the solution shown here, each stirrer unit 13 comprises two stirrer elements 14 attached radially on each shaft 15.

The stirrer elements 14, which can also have a different number and disposition than that shown here, can be made of resistant plastic material, or steel, or stainless steel or aluminum alloy.

Furthermore, the stirrer elements 14 can be made in a plurality of forms, such as rectangular blades or any other quadrangular shape. They can be flat or inclined, their surface can be continuous or holed, or have surface ridges or incisions to facilitate the homogenization of the paint.

In one embodiment, during the rotation of the shafts 15, the stirrer elements 14 are configured so that their contact surface with the fluid contained in the tank 11 is substantially perpendicular to the direction of rotation.

Moreover, according to this embodiment, the stirrer elements 14 are conformed so that the fluid is moved substantially along at least the level reached by the fluid in the tank 11.

In particular, in this embodiment, the stirrer elements 14 are disposed substantially over the whole longitudinal extension of the shafts 15, so that each shaft 15 does not have, along the longitudinal direction, one or more surface portions that are not affected spatially by a stirrer element 14 attached to the corresponding shaft 15.

In other words, there is no zone around each shaft 15 that is not spatially affected by a corresponding stirrer element 14 attached to the shaft 15, and that therefore is not stirred.

In this way, there is at least one stirrer element 14 stirring each of the spatial portions that make up the volume occupied by the fluid in the container 11, including the area near the bottom of the tank 11.

In a particular embodiment shown in FIG. 2, the stirrer elements 14 can have one or more through holes 16 to make them lighter, with a different diameter, bigger or smaller than each other.

The through holes 16 are disposed along an imaginary vertical axis of the stirrer elements 14, translated with respect to the central vertical axis (Y1) of the stirrer element 14 toward the outside.

This strategy not only makes the stirrer element 14 lighter, but also reduces its inertia moment, because portions farthest from the axis of rotation of the shaft 15 are removed and these, as is known, contribute most to the inertia moment associated with a rotating body.

This causes a reduction in the mechanical resistance and therefore there is a reduction in the mechanical energy needed to make the shafts 15 with which the stirrer elements 14 are associated rotate.

Furthermore, the presence of the holes on the surface of the stirrer elements 14 increases the circulation of the fluid in the tank 11 and hence the mixing of the fluid. In fact, during the rotation of the stirrer elements 14, if they are solid and perpendicular to the direction of rotation, the fluid near the surface of the stirrer element 14 comes to have a speed substantially the same as the stirrer element 14 itself.

Consequently, the fluid near the surface of the stirrer element 14 does not mix with the remaining fluid, until a solid layer is created on the surface of the stirrer element 14.

In a particular embodiment, the stirrer elements 14 can be attached on the axis of rotation of the shaft 15 in correspondence with their long side, or their short side, and the free side can be either perpendicular or inclined (for example inclination of 30°) with respect to the axis of the shaft 15.

In another embodiment, the stirrer elements 14 adjacent to the bottom of the tank 11 can have an inclined and pointed shape so as to scrape the bottom of the tank 11 in order to remove possible sedimentations of paint.

In another embodiment, at least two stirrer elements 14 can be attached on the shaft 15 in a position staggered with respect to each other by 180°, or more than two stirrer elements 14 can be attached, staggered with respect to each other by 90°, or with other possible angles.

The radial dimension of the stirrer elements 14 with respect to the respective longitudinal axis $X_1$ or $X_2$ is such as to be slightly less than the radius of the cylinders 23 ($D_{1/2}$), taking into consideration the bulk given by the shaft 15 and finding the correct compromise to prevent friction with the internal wall of the tank 11 and at the same time to maximize the cover of the overlapping zone 12 during the rotation of the stirrer elements 14.

One configuration of the stirrer elements 14 obtained according to the above embodiment requires an accurate stagger of the stirrer elements 14 comprised in the two different stirrer units 13, so as to allow an adequate homogenization of the whole internal volume of the tank 11, and to prevent the stirrer elements 14 from knocking against and interfering with each other. Therefore, between the two different stirrer units 13 there must be a stagger sufficient to prevent interference of the stirrer elements 14, for example the stagger can be 90°, or 45° or 30° or any other stagger. The stagger must be adequate for the number of stirrer elements 14 installed in each stirrer unit 13, sufficient to prevent this disadvantage and to guarantee an adequate homogenization of the paint.

Each stirrer unit 13, in the non-restrictive embodiment shown here, is connected to an idle toothed wheel 17 by coupling the lower end of the shaft 15.

A third toothed wheel 18 is provided, able to impart motion to the stirrer units 13 by coupling with the two idle toothed wheels 17.

The third toothed wheel 18 is connected by means of a rotation shaft 20 to a timed motor 19.

The motor 19 is located on a specific support 21, positioned in the lower part of the tank 11 together with the idle toothed wheels 17 and the third toothed wheel 18.

The motor 19 imparts motion to the third toothed wheel 18 which in turn transmits the motion to the two idle toothed wheels 17 and hence to the corresponding stirrer units 13 to homogenize the paint inside the tank 11.

A movement system made in this way allows to be certain that the idle toothed wheels 17, suitably engaged, ensure that the angle of stagger between the two stirrer units 13 remains constant, preventing any interference between the stirrer elements 14.

A movement system conceived differently, and not providing an independent, non-synchronized movement of the stirrer units 13, would not guarantee a constant stagger due to the different densities of the paint, or other friction forces exerted on the stirrer unit 13.

One or more suction elements 22 are comprised on the lower part of the tank 11, and can be connected by suitable pipes to pumping delivery means (not shown in the drawings).

One or more connection elements 24 are comprised on the upper part of the tank 11, to recirculate the fluid, and are connected by suitable pipes to metering elements (not shown in the drawings).

The embodiments described above allow to optimize the homogenization of the paint, allowing to prevent dead zones, i.e. zones not affected by the stirring, thanks to the joint solution of the particular configuration of the tank 11 and the configuration of the stirrer elements 14 belonging to the stirrer units 13.

Furthermore, the disposition of the two stirrer units 13 allows to obtain a homogenization at two different times by both stirrer elements 14, thus ensuring the complete mixing of the fluid contained inside the tank 11.

It is clear that modifications and/or additions of parts may be made to the stirrer device for fluid products as described heretofore, without departing from the field and scope of the present invention.

It is also clear that, although the present invention has been described with reference to some specific examples, a person of skill in the art shall certainly be able to achieve many other equivalent forms of stirrer device for fluid products, having the characteristics as set forth in the claims and hence all coming within the field of protection defined thereby.

I claim:

1. A container with a stirrer device suitable to be installed, together with other containers of the same type, on machines for dispensing fluid products, such as colorants, the container comprising a tank configured so as to be shaped like a figure "8" and having an area of overlapping caused by co-penetration of two cylinders with respective longitudinal axes such that a distance between the two longitudinal axes of the cylinders is less than a diameter of the cylinders, and in which two stirrer units are comprised, each coaxial to a respective one of said cylinders of said tank, and each comprising at least two stirrer elements with a radial dimension a little less than a radius of said cylinders to prevent friction with an internal wall of the tank while maximizing coverage of the overlapping area during rotation of the stirrer elements, wherein said stirrer elements are attached to shafts rotating axially, and are disposed substantially on a whole longitudinal length of said shafts, wherein at least two stirrer elements are attached on each shaft and are in a position staggered radially with respect to each other by 180°, or more than two stirrer elements are attached staggered radially with respect to each other by 90°, wherein the at least two stirrer elements comprise at least one upper stirrer element affecting an upper portion of the shaft and at least one lower stirrer element affecting a lower portion of the shaft, wherein the at least one upper stirrer element is disposed with respect to the at least one lower stirrer element so that the at least one upper stirrer element and the at least one lower stirrer element cover, together but in a manner staggered longitudinally one to the other, substantially the whole longitudinal length of said shafts with a portion of the longitudinal length in which the at least one upper stirrer element extends is followed by a complementary lower longitudinal portion of length of the shaft devoid of any stirrer element and the longitudinal portion of length in which the at least one lower stirrer element extends is followed by an upper complementary longitudinal portion of length devoid of any stirrer element.

2. The container as in claim 1, Wherein said stirrer elements cover said overlapping area so as to be involved in the process of stirring the fluid product.

3. The container as in claim 1, wherein said stirrer elements comprise one or more through holes on their surface of even or different size, said through holes being disposed along an imaginary vertical axis of said stirrer element translated with respect to the central vertical axis of said stirrer element toward the outside.

4. The container as in claim 1, wherein said stirrer units are installed so as to have, with respect to each other, a radial displacement that can be equal to 90°, or 45° or 30°.

5. The container as in claim 1, wherein said stirrer units are connected to idle toothed wheels coupled to a third toothed wheel that imparts the rotation motion to the stirrer units by means of a motor, keeping the angle of displacement constant between said stirrer units.

6. The container as in claim 1, wherein each stirrer unit is associated to a motor and is synchronized with respect to the other stirrer unit so as to maintain the initial displacement between said stirrer units.

7. The container as in claim 3, wherein said stirrer elements are made of a resistant plastic material, steel or stainless steel, or an aluminum alloy.

8. The container as in claim 3, wherein said stirrer elements have a rectangular configuration or other quadrangular shape, a continuous surface, or have through holes disposed on the surface in a different way, or are flat or inclined.

9. The container as in claim 1, wherein the stirrer elements located more adjacent to a bottom of said tank, and comprised in each of the two stirrer units, have an inclined and cutting shape so as to serape the bottom of the tank in order to remove possible sedimentations of paint.

10. A machine for dispensing fluid products such as colorants, comprising an internal chamber to contain a plurality of tanks as in claim 1.

11. A container with a stirrer device suitable to be installed, together with other containers of the same type, on machines for dispensing fluid products, comprising: a tank configured so as to be shaped like a figure "8" and having an area of overlapping caused by co-penetration of two cylinders with respective longitudinal axes such that a distance between the respective longitudinal axes of the two cylinders is less than a diameter of the cylinders, and in which two stirrer units are comprised, each coaxial to a respective one of said cylinders of said tank, and each comprising stirrer elements with the radial dimension a little Less than a radius of said cylinders to prevent friction with an internal wall of the tank while maximizing coverage of the overlapping area during rotation of the stirrer elements, wherein said stirrer elements are attached to shafts rotating axially, and are disposed substantially on a whole longitudinal length of said shafts, wherein each stirrer unit comprises one of said shafts having at least two stirrer elements attached thereon in a position radially staggered with respect to each other, wherein the at least two stirrer elements comprise at least one upper stirrer element affecting the upper portion of the shaft and at least one lower stirrer element affecting the lower portion of the shaft, wherein the at least one upper stirrer element is disposed with respect to the at least one lower stirrer element so that the at least one upper stirrer element and the at least one lower stirrer element cover, together but in a manner staggered longitudinally one to the other, substantially the whole longitudinal length of said shafts with a portion of the longitudinal length in which the at least one upper stirrer element extends is followed by a complementary lower longitudinal portion of length of the shaft devoid of any stirrer element and the longitudinal portion of length in which the at least one lower stirrer element extends is followed by an upper complementary longitudinal portion of length devoid of any stirrer element.

12. The container as in claim 11, wherein the at least two stirrer elements are radially staggered with respect to each other at an angle of 180° or 90°.

13. The container of claim 1, wherein said stirrer elements comprise a continuous surface.

14. The container of claim 1, wherein said stirrer elements have through holes disposed on the surface.

15. The container of claim 1, wherein said stirrer elements are flat.

16. The container of claim 1, wherein said stirrer elements are inclined.

17. A container with a stirrer device suitable to be installed, together with other containers of the same type, on machines for dispensing fluid products, comprising:

a tank configured so as to be shaped like a figure "8" and having an area of overlapping caused by co-penetration of two cylinders with respective longitudinal axes such that a distance between the respective longitudinal axes of the two cylinders is less than a diameter of the cylinders, and in which two stirrer units are comprised, each coaxial to a respective one of said cylinders of said tank, and each comprising stirrer elements with the radial dimension a little less than a radius of said cylinders to prevent friction with an internal wall of the tank while maximizing coverage of the overlapping area during rotation of the stirrer elements, wherein said stirrer elements are attached to shafts rotating axially, and are disposed substantially along a longitudinal length of said shafts, with each stirrer unit comprising one of said shafts, and each of the shafts having at least an upper stirrer element and at least a lower stirrer element, each of the at least one upper stirrer and each of the at least one lower stirrer element attached rotatably to the shaft, wherein each of the at least one upper stirrer elements is staggered both radially and longitudinally from one of the at least one lower stirrer elements, such that together the at least one upper stirrer element and the at least one lower stirrer element cover the longitudinal length of shaft to which they are attached and when a portion of the longitudinal length from which the at least one upper stirrer element extends there is a complementary portion of the longitudinal length to which the at least one lower stirrer element is rotatably attached that is not extending and when a portion of the longitudinal length from which the at least one lower stirrer element extends there is a complementary portion of the longitudinal length to which the at least one upper stirrer element is rotatably attached that is not extending.

* * * * *